US005666106A

United States Patent [19]

Nasman

[11] Patent Number: 5,666,106

[45] Date of Patent: Sep. 9, 1997

[54] ACCESSWAY WITH GROUNDING SENSOR

[75] Inventor: James M. Nasman, Boise, Id.

[73] Assignee: Micron Electronics, Inc., Nampa, Id.

[21] Appl. No.: 706,294

[22] Filed: Sep. 4, 1996

[51] Int. Cl.[6] ..... G08B 21/00

[52] U.S. Cl. ..... 340/649; 340/650; 340/825.31; 340/825.32; 324/510; 361/212; 382/115

[58] Field of Search ..... 340/649, 650, 340/561, 542, 543, 825.31, 825.32; 324/509, 557, 510; 361/212, 223, 224, 216; 382/115, 124; 341/22, 32

[56] References Cited

U.S. PATENT DOCUMENTS

| | | | |
|---|---|---|---|
| H330 | 9/1987 | Burich et al. | 324/500 |
| 3,538,501 | 11/1970 | Nance | 340/825.32 |
| 4,060,935 | 12/1977 | Miller et al. | 49/25 |
| 4,742,327 | 5/1988 | Burgess et al. | 340/825.32 |
| 4,785,294 | 11/1988 | Campbell | 340/649 |
| 4,800,374 | 1/1989 | Jacobson | 340/649 |
| 4,857,916 | 8/1989 | Bellin | 382/115 |
| 4,975,686 | 12/1990 | Delcourt | 340/659 |
| 5,034,726 | 7/1991 | Blondin | 340/649 |
| 5,057,965 | 10/1991 | Wilson | 361/212 |
| 5,218,306 | 6/1993 | Bakhoum | 324/509 |
| 5,235,783 | 8/1993 | Huber et al. | 49/42 |
| 5,325,084 | 6/1994 | Timm et al. | 340/825.32 |
| 5,331,502 | 7/1994 | Bakhoum | 361/212 |
| 5,422,630 | 6/1995 | Quinn et al. | 340/661 |
| 5,491,471 | 2/1996 | Stobbe | 340/825.34 |

*Primary Examiner*—Jeffery Hofsass
*Assistant Examiner*—John Tweel, Jr.
*Attorney, Agent, or Firm*—Seed and Berry LLP

[57] ABSTRACT

An electronically controlled accessway includes a touch pad mounted to or immediately in front of, a door panel. A step plate is positioned immediately in front of the door. A user stands on the step plate to open the door and contacts the touch pad. A grounding sensor coupled to the touch pad and the step plate detects resistance between the touch pad and the step plate. If the resistance between the touch pad and the step plate is within a designated range, the grounding sensor releases an electronically controlled locking mechanism to permit the door to be opened. If the grounding sensor detects that the person is not properly grounded, the grounding sensor leaves the locking mechanism engaged to prevent the person from entering the statically sensitive area. In one embodiment, the door panel is pivotable about conventional hinges and the touch pad is integral to the door handle. In another embodiment, the door is a revolving door and the touch pad is integral to push plates mounted to the revolving door panels. In another embodiment the door is an electronically driven sliding door and the touch pad is mounted separately from the door panel. In this embodiment, the touch pad is mounted adjacent the door and the step plate is mounted directly in front of the door. When a properly grounded person stands on the step plate and touches the touch pad, the sensor activates an electronic door opener, thereby opening the door.

22 Claims, 3 Drawing Sheets

ACCESSWAY WITH GROUNDING SENSOR

TECHNICAL FIELD

The present invention relates to electrostatic discharge protection in electronic fabrication facilities.

BACKGROUND OF THE INVENTION

Many electronic devices operate at low voltages. Such devices typically include very small conductive pathways that can be damaged easily if subjected to high currents and relatively thin insulative layers that can be damaged easily if subjected to high voltages.

A significant cause of such damage to such electronic parts is electrostatic discharge ("ESD"). Electrostatic discharge is caused by the statically induced buildup of charge on a person or object that can raise the voltage of the person or object to several thousands of volts. If a path to a low voltage is provided to the built up charge, the charge quickly transfers or "discharges" along the path forming a brief, high current that can damage the electronic device. Also, the high voltage can break down and damage insulative layers positioned between a conductor to which the high voltage is coupled and another conductor that is at a lower voltage, such as ground.

Persons who handle electronic devices are a particularly troublesome source of electrostatic charge. As such persons move about a facility in typical fashion, such as by walking, they can build up significant electrostatic charge such that their bodies are at several thousand volts relative to ground. When the person comes near to, or in contact with, a sensitive electronic device, the voltage differential between the person and the device causes charge to transfer rapidly from the person to the device. The rapid transfer of charge can damage or destroy the sensitive part.

Electrostatic discharge is particularly troublesome before the electronic part is packaged. Before packaging, extremely sensitive circuits and circuit elements may be exposed and may come near or in contact with an electrostatically charged person or object, making unpackaged parts particularly sensitive to ESD damage. Also, devices may be on a common substrate and a single electrostatic discharge to a region of the substrate can destroy many parts simultaneously. Thus, in a production facility, a person can unknowingly damage many electronic devices.

Several ESD protection techniques have been developed to prevent persons from causing such ESD damage. For example, persons entering production facilities are typically required to wear a grounding device. One of the most common types of grounding devices is a form of conductive footwear. Conductive footwear include shoes having conductive soles or conductive booties that surround the person's shoes and grounding straps that strap around a person's shoes. The grounding strip or a conductive strap coupled to the conductive soles or booties makes contact with the person's leg to provide a discharge path from the person to a conductive floor of the facility. Thus, each of the types of conductive footwear provides a conductive path between the person's body and a conductive floor of a facility. The conductive path dissipates electrostatically induced charge from the person's body such that the person's body is maintained substantially at zero volts.

Sometimes such conductive footwear or other grounding techniques fail to perform properly. For example, conductive straps may be damaged or improperly worn such that they do not form a conductive path between the person's body and ground. Such damage to the conductive strap is typically not visible to the naked eye.

To reduce the threat of electronic parts being damaged by ESD, various grounding verification approaches have been attempted. For example, U.S. Pat. No. 4,800,374 to Jacobson describes a personnel antistatic test device that has a conductive shoe plate and a conductive touch plate. The person stands on the shoe plate and places a hand on the touch plate. The antistatic device then measures a resistance between the shoe plate and the touch plate. A lighting indicator indicates whether the resistance is within the allowable range. If the indicator indicates the resistance is within the allowable range, the person then enters a statically sensitive environment through an accessory such as a door. If the indicator indicates that the resistance is outside of the allowable range, the person adjusts or replaces the conductive footwear.

SUMMARY OF THE INVENTION

A controlled accessway for a controlled area, such as a production facility, is activated by a grounding sensor. In one embodiment, a touch pad integral to the door handle forms one electrode of the grounding sensor and the step plate positioned on the floor immediately in front of the door forms the second electrode. The door handle is a conductive handle shaped like a conventional door handle, such as a circular door knob or a bar-type door lever. When a person stands on the step plate and grasps the handle of the door, the grounding sensor detects the resistance between the door handle and the step pad. If the resistance is within a designated range, the grounding sensor activates a locking mechanism to unlock the door and allow the door to be opened.

In another embodiment of the invention, the door is a revolving door and the touch pad is integral to press pads mounted to each panel of the revolving door. The step pad is positioned beneath the revolving door. When a person stands on the step pad and pushes on the push pad to turn the revolving door, the grounding sensor monitors the resistance between the push pad and the step pad to determine if the person is properly grounded. If the resistance is within the designated limits, the grounding sensor releases the locking mechanism, thereby allowing the revolving door to rotate. If the resistance is not within the designated range, the grounding sensor leaves the locking mechanism locked, thereby preventing the revolving door from rotating and preventing the person from entering the controlled area.

In another embodiment of the invention, the grounding sensor activates visual indicators, such as LEDs, in addition to activating the locking mechanism. The grounding sensor thereby provides a visual indication to the person of the person's grounding state, in addition to controlling the opening of the door.

In another embodiment, the door is an electronically controlled automatic sliding door, such as those found in a grocery store. The step pad and touch pad are mounted in front of the door and a user stands on the step pad and touches the touch pad. If the user is properly grounded, the grounding sensor activates the door opener and the door slides open. If the person is not properly grounded, the door remains closed.

DETAILED DESCRIPTION OF THE INVENTION

Figure 1:
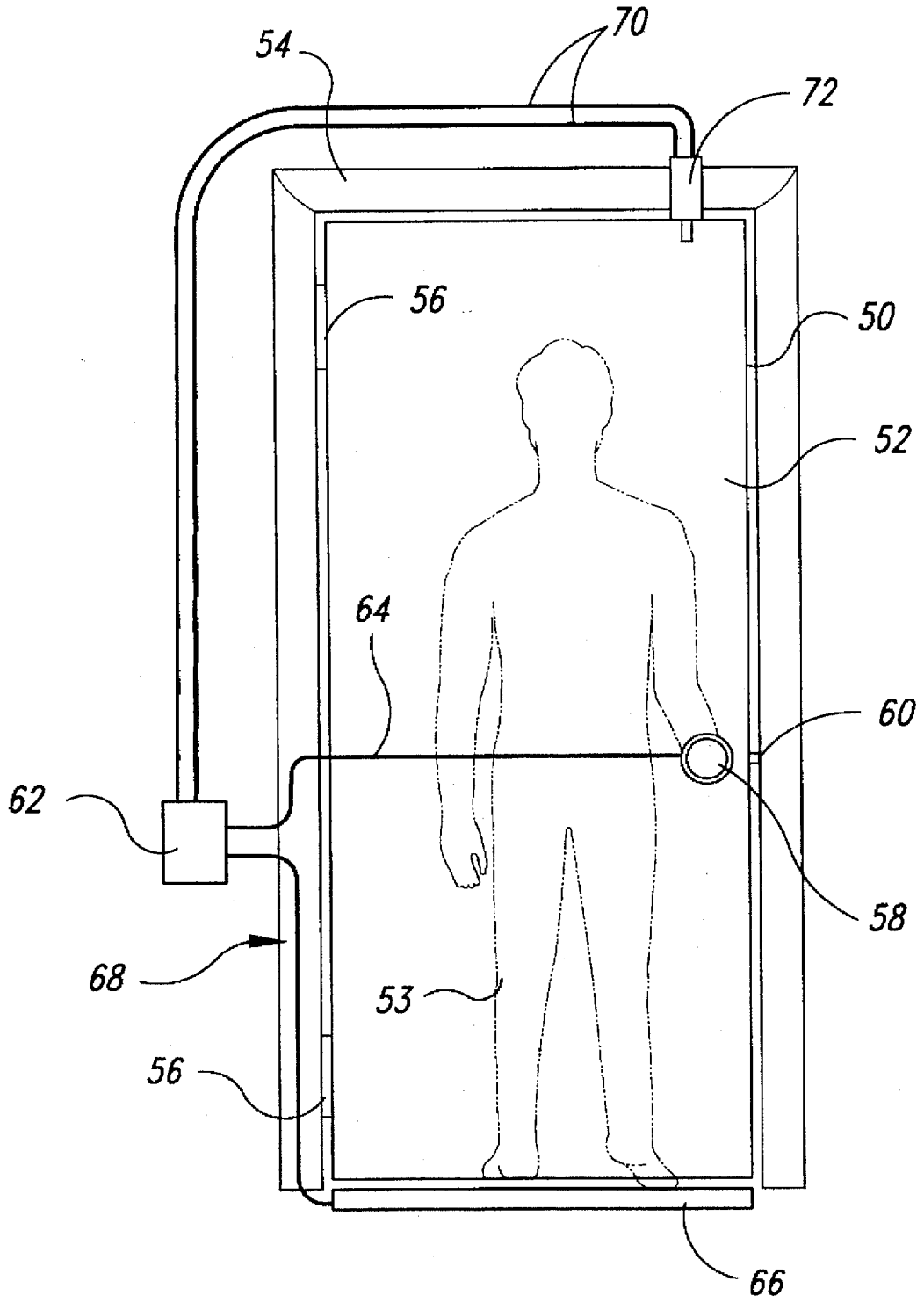
FIG. 1 is a front elevational view of a door and grounding sensor where the grounding sensor is coupled to a door handle, a locking mechanism, and a foot plate.

As shown in FIG. 1, a door 50 to a statically sensitive facility is formed from a door panel 52 mounted to a door frame 54 by a pair of hinges 56. A conductive door handle 58 is mounted to the door panel 52 in a conventional location. As is conventional, a person 53 (in shadow) opens the door 50 by gasping and mining the handle 58 to release a conventional door latch 60. The person 53 then pulls the door handle 58 to cause the door panel 52 to rotate about the axis of the hinges 56.

Unlike a conventional door handle, the door handle 58 is electrically coupled to a grounding sensor 62 by a conductive lead 64. The grounding sensor 62 is a known device such as that described in U.S. Pat. No. 4,800,374 to Jacobson or U.S. Pat. No. 4,785,294 to Campbell, which are incorporated herein by reference, or any other commercially available grounding sensor. A conductive step plate 66 lies on the floor in front of the door 50. The step plate 66 is connected to the grounding sensor 62 by a wire 68. The handle 58 and the step plate 66 form the electrodes of the grounding sensor 62.

To open the door 50, the person 53 stands on the step plate 66 and grasps the handle 58. The grounding sensor 62 senses the resistance between the door handle 58 and the step plate 66. If the resistance of the conductive path formed by the user is within a designated range of resistance corresponding to proper grounding, the grounding sensor 62 provides an enabling signal on a pair of wires 70 to activate a conventional electronically controlled locking mechanism 72 mounted to the door frame 54. In response to the enabling signal, the locking mechanism 72 releases the door panel 52 and allows the person 53 to open the door 50 by pivoting the door panel 52 about the hinges 56.

If the grounding sensor 62 detects that the resistance between the door handle 58 and the step plate 66 is outside of the designated range corresponding to proper grounding, the grounding sensor 62 does not output the enabling signal and the locking mechanism 72 remains locked to prevent the door panel 52 from rotating about the hinges 56.

Figure 2:
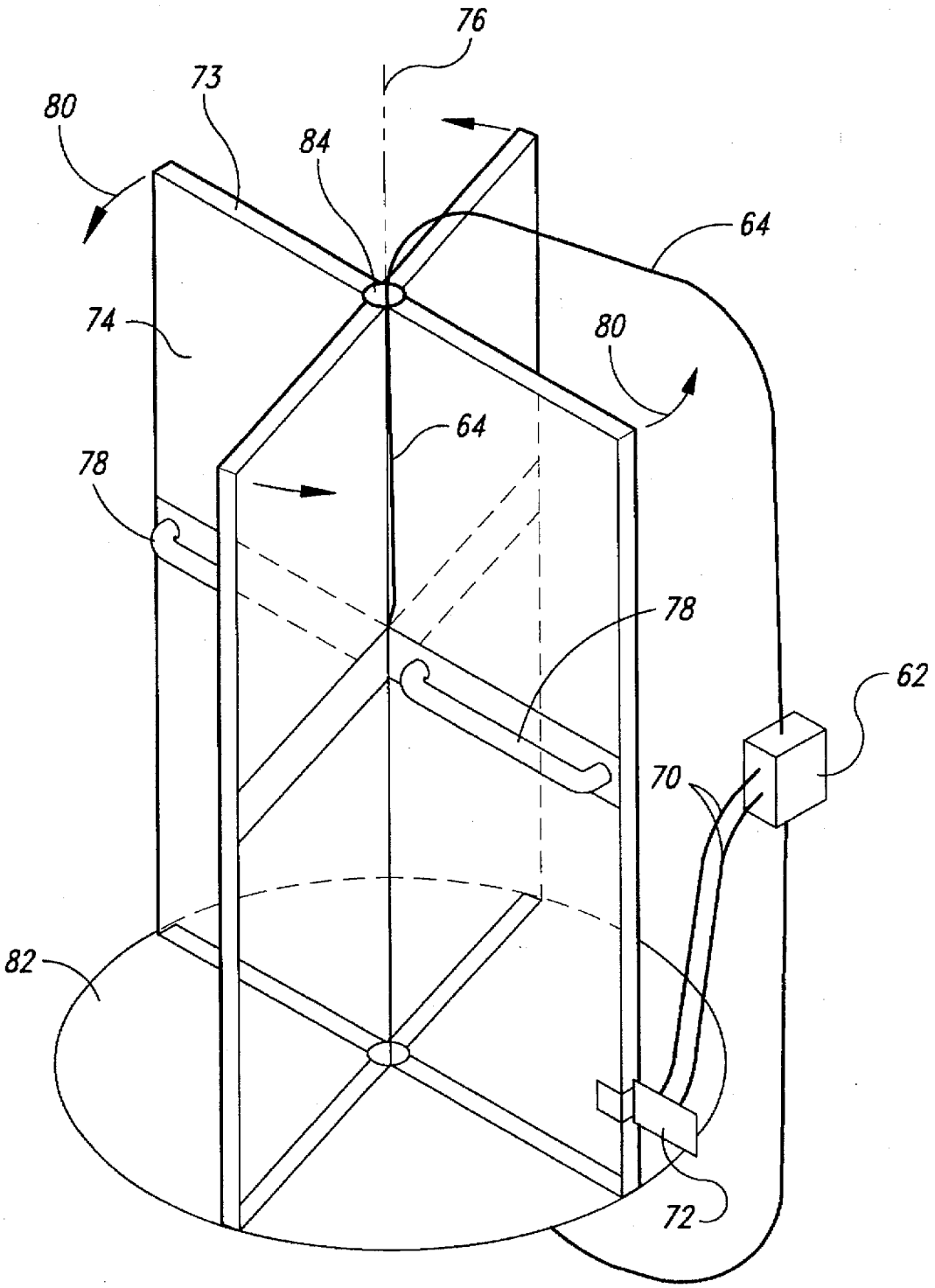
FIG. 2 is an isometric view of a revolving door according to the invention where push plates on each of the door members form touch pads and a locking mechanism controls rotation of the revolving door.

FIG. 2 shows an embodiment of the invention including a revolving door 73 having four panels 74, each projecting from a pivot axis 76. Each of the panels 74 includes a conductive push bar 78 positioned slightly above waist level. As is conventional, the push bars 78 form surfaces against which the person 53 (not shown in FIG. 2) applies force to rotate the revolving door 73 about the pivot axis 76, as indicated by the arrows 80. Each of the push bars 78 is coupled to a conductive lead 64 that is electrically connected to a first side of a rotatable electrical connector 84. The opposite terminal of the rotatable electrical connector 84 is connected to the grounding sensor 62. A circular, conductive step plate 82 lies on the floor beneath the revolving door 73. The step plate 82 is also connected to the grounding sensor 62, such that the push bars 78 and step plate 82 form the two electrodes of the grounding sensor 62.

As described above with respect to FIG. 2, the grounding sensor 62 detects the presence of a properly grounded person (not shown in FIG. 2) by monitoring the resistance between the push bars 78 and the step plate 82. When the resistance between the push plates and the step plate 82 is within the designated limits, the grounding sensor 62 provides the enabling signal along the pair of wires 70 to activate the locking mechanism 72 and thereby permit the revolving door 73 to revolve about the pivot axis 76.

Figure 3:
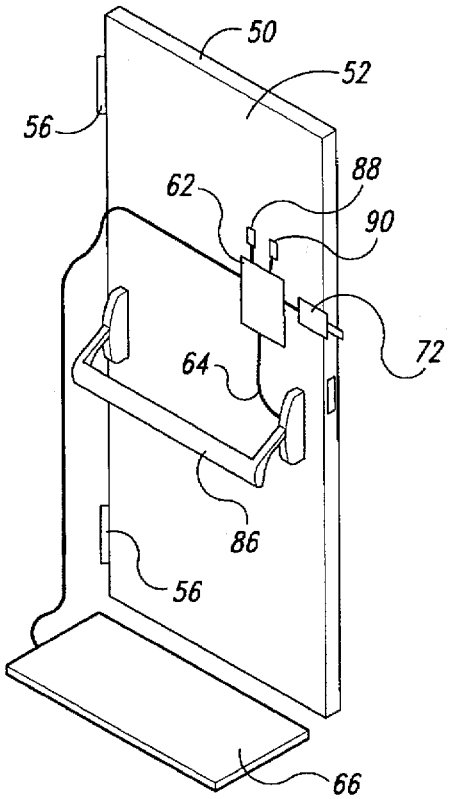
FIG. 3 is a front elevational view of a door where a piess bar of a door lever forms a touch pad and where a grounding sensor and locking mechanism are both mounted to the door.

FIG. 3 shows another embodiment of the invention in which the door handle 58 of FIG. 1 is replaced by a door lever 86. Additionally, the grounding sensor 62 is mounted to the door panel 52 rather than to a surrounding wall. As described above, the grounding sensor 62 monitors the resistance between the step plate 66 and the door lever 86 to determine whether the person (not shown) is properly grounded. If the person is properly grounded, the grounding sensor activates the locking mechanism 72 to let the door panel 52 pivot about the hinges 56.

Green and red LEDs 88, 90 are also connected to the grounding sensor 62 and are mounted to the door panel 52 at about eye level. If the grounding sensor 62 detects that the resistance between the step plate 66 and the door lever 86 is outside of the designated range, the grounding sensor 62 activates the red LED 90 to visually indicate to the person that the grounding sensor 62 has not detected proper grounding and has not released the locking mechanism 72. If the grounding sensor 62 detects that the resistance between the step plate and the door lever 86 is within the designated range, the grounding sensor 62 activates the green LED 88 to visually indicate that the person 53 is properly grounded.

Figure 4:
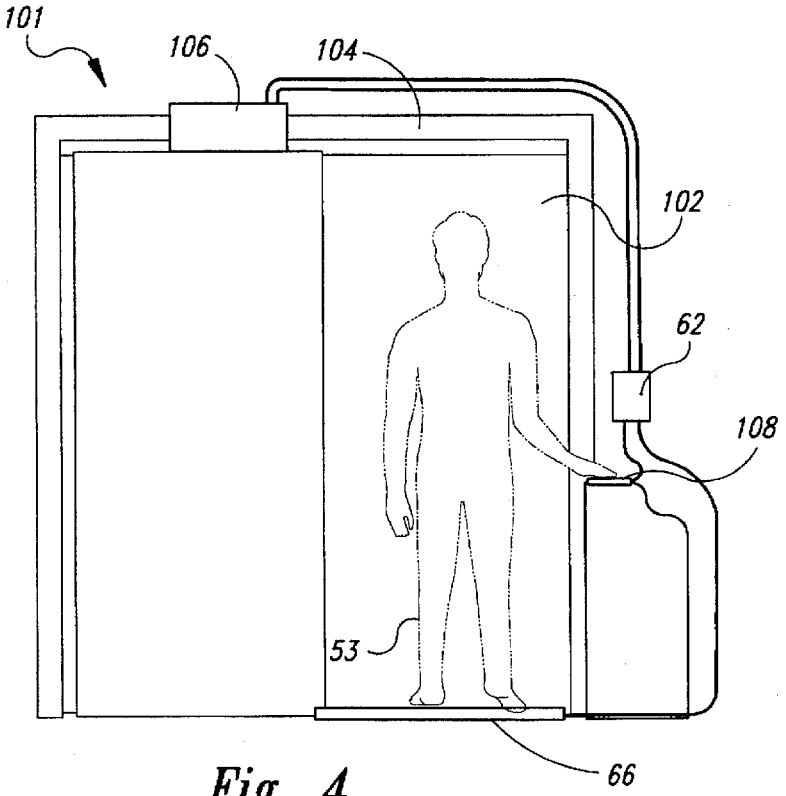
FIG. 4 is a front elevational view of a sliding door assembly including an electrically controlled automatic door opener coupled to a grounding sensor.

FIG. 4 shows another embodiment of the invention which includes an electronically controlled automatic sliding door that is part of an electronic door assembly 101. The sliding door is formed from a door panel 102 that is propelled along a track 104 by an electronic door opener 106. The sliding door and door opener 106 are similar to typical electrically opened sliding doors found in grocery stores and the like.

Unlike conventional sliding doors, however, the door assembly 101 includes the grounding sensor 62, the step plate 66 and a touch pad 108, instead of conventional pressure plates or infrared sensors. The door assembly 101 is activated by the grounding sensor 62 in response to the sensed resistance between the touch pad 108 and the step plate 66. In use, the person 53 (in shadow) stands on the step plate 66 and places a hand on the touch pad 108. If the grounding sensor 62 detects that the resistance between the step plate 66 and the touch plate 108 is within the designated range, the grounding sensor 62 activates the door opener 106. The door opener 106 slides the door panel 102 along the track 104 to open the door and provide access to the person 53.

While the invention has been explained herein by way of exemplary embodiments, various modifications may be made without departing form the scope of the invention. For example, the LEDs 88, 90 of FIG. 3 can be incorporated in any of the embodiments of FIGS. 1, 2 and 4. Similarly, the electrically opened door assembly 101 can include a door panel 52 pivotable about hinges or a revolving door structure such as that of FIG. 2. Also, while the locking mechanism 72 has been described herein as remaining locked until proper grounding is detected, the locking mechanism 72 can be configured in a normally open position. In such a configuration, the locking mechanism 72 engages to prevent the door 50, 73, or 101 from opening when both a person was present and the monitored resistance was outside of the designated range. Furthermore, the doors 50, 73, 101 described herein may be replaced by any other type of entry limiting device, such as a turnstile or gate. Moreover, the grounding sensor 62 and stop plate 66 can each be coupled to a reference potential rather than being directly corrected by a wire. Additionally, in some applications, the locking mechanism 72 can be eliminated and a visual indicator such as the LEDs 88, 90 can indicate grounding of person 53. Accordingly, the invention is not limited except as by the appended claims.

I claim:

1. A controlled accessway for a controlled area, comprising:

an entry limiting device movable from a closed position to an open position in response to contact from a person, the entry limiting device being positioned to provide access to the controlled area;

an electrically controllable locking mechanism configured to selectively control the movement of the entry limiting device between the closed position and the open position, the electrically controllable locking mechanism preventing the entry limiting device from moving from the closed position to the open position in response to an enter signal having a first state and allowing the entry limiting device to move from the closed position to the open position in response to the enter signal having a second state;

a touch pad associated with the entry limiting device and positioned and shaped for contact by the person;

a step plate positioned adjacent to the entry limiting device; and a grounding sensor electrically coupled to the locking mechanism, the touch pad and the step plate, the grounding sensor being configured to generate the enter signal having the second state in response to the resistance between the touch pad and the step plate being lower than a predetermined value.

2. The accessway of claim 1 wherein the entry limiting device is a door.

3. The accessway of claim 2 wherein the door includes a door handle and the touch pad is integral to the door handle.

4. The accessway of claim 3 wherein the door is operable by rotation about a pivot axis.

5. The accessway of claim 4 wherein the handle is a substantially planar pressure pad.

6. The accessway of claim 4 wherein the handle is shaped for grasping by the hand of the user.

7. The accessway of claim 4 wherein the door is a revolving door having a plurality of door panels and the touch pad includes a plurality of path plates, each mounted to a respective one of the door panels.

8. The accessway of claim 1, further comprising a visual indicator positioned for viewing by the person, the visual indicator being coupled to a grounding sensor.

9. An entryway enabling apparatus for opening a door, comprising:

a first member mountable to the door and shaped for contact by a hand of a user, the first member including a first exposed conductive surface;

a conductive step pad;

a door control mechanism responsive to an entryway enabling signal to permit the door to open; and an electronic grounding sensor electrically coupled to the conductive surface and the step pad, the grounding sensor configured to produce the entryway enabling signal when a grounded person contacts the step pad and the conductive surface simultaneously.

10. The entryway enabling apparatus of claim 9, further including a locking mechanism coupled for activation by the grounding sensor.

11. The entryway enabling apparatus of claim 10 for use with a revolving door having a plurality of door panels, further comprising a second member including a second exposed conductive surface, the second exposed conductive surface being electrically coupled to the grounding sensor, wherein the first and second members are separately mountable to respective ones of the door panels.

12. The entryway enabling apparatus of claim 9, further comprising an electronic door opener coupled to the grounding sensor, the door opener being responsive to open the door in response to an actuating signal from the grounding sensor.

13. The entryway enabling apparatus of claim 9 wherein the first member is a door handle, further comprising a door latch coupled to the door handle.

14. The entryway enabling apparatus of claim 13, further comprising an electrically controlled locking mechanism separate from the door latch and coupled for activation by the grounding sensor.

15. The entryway enabling apparatus of claim 9, further comprising a visual indicator mounted for viewing by a user, the visual indicator being coupled for activation by the grounding sensor.

16. A method of detecting grounding equipment operability, comprising the steps of:

mounting a contact pad to a door;

positioning a step pad adjacent the door;

detecting an impedance between the contact pad and the step pad; and when the detected impedance is above a selected impedance, preventing the door from opening.

17. The method of claim 16 wherein the step of mounting the contact pad on the door includes the steps of:

positioning the contact pad on a push pad; and mounting the push pad to the door.

18. The method of claim 16 wherein the contact pad is integral to a door handle and the step of positioning the contact pad on the door comprises the step of mounting the door handle to the door.

19. The method of claim 16 where the door includes a door handle further including the step of detecting attempted activation of the door handle and the step of blocking the door from opening includes disabling the door handle such that such attempted actuation does not open the door.

20. A method of providing access to a person at a statically sensitive facility, comprising the steps of:

mounting an entry limiting assembly of an access location of the facility;

electronically sensing the grounding state of the person;

producing an electrical signal indicating the sensed grounding state of the person;

providing the electrical signal to an electronically controlled opening assembly; and enabling opening of the entry limiting assembly in response to the electrical signal.

21. The method of claim 20 wherein the step of enabling opening of the entry limiting assembly comprises the step of releasing a locking mechanism.

22. The method of claim 20 wherein the opening assembly is an electronic door opener, further comprising the step of, in response to the electrical signal, moving the entry limiting assembly from a closed position to an open position with the electronic door opener.

* * * * *